US010428681B2

(12) United States Patent
Finlayson et al.

(10) Patent No.: US 10,428,681 B2
(45) Date of Patent: Oct. 1, 2019

(54) CONTAINMENT CASING

(71) Applicant: ROLLS-ROYCE plc, London (GB)

(72) Inventors: James A Finlayson, Ashby-de-la-Zouch (GB); Dale E Evans, Derby (GB); Ian C D Care, Derby (GB)

(73) Assignee: ROLLS-ROYCE plc, London (GB)

( * ) Notice: Subject to any disclaimer, the term of this patent is extended or adjusted under 35 U.S.C. 154(b) by 499 days.

(21) Appl. No.: 15/153,339

(22) Filed: May 12, 2016

(65) Prior Publication Data

US 2016/0356286 A1 Dec. 8, 2016

(30) Foreign Application Priority Data

Jun. 5, 2015 (GB) ..... 1509771.0

(51) Int. Cl.
*F04D 29/52* (2006.01)
*F04D 29/02* (2006.01)
*F01D 21/04* (2006.01)

(52) U.S. Cl.
CPC ..... *F01D 21/045* (2013.01); *F05D 2250/184* (2013.01); *F05D 2250/61* (2013.01); *F05D 2300/603* (2013.01)

(58) Field of Classification Search
CPC ..... F05D 2250/121; F05D 2250/131; F05D 2250/132; F05D 2250/184; F05D 2250/61; F05D 2250/611
USPC ..... 415/9
See application file for complete search history.

(56) References Cited

U.S. PATENT DOCUMENTS

| | | | | |
|---|---|---|---|---|
| 4,492,078 | A * | 1/1985 | Williamson | F01D 25/24 415/213.1 |
| 6,575,694 | B1 * | 6/2003 | Thompson | F01D 21/045 415/173.4 |
| 8,757,958 | B2 * | 6/2014 | Lussier | F01D 21/045 415/9 |
| 9,714,583 | B2 * | 7/2017 | Watson | B23P 15/04 |
| 2003/0120415 | A1 | 6/2003 | Seeley et al. | |

FOREIGN PATENT DOCUMENTS

| | | | |
|---|---|---|---|
| EP | 0245190 | A2 | 11/1987 |
| EP | 2371714 | A2 | 10/2011 |
| GB | 2129501 | A | 5/1984 |
| GB | 2226086 | A | 6/1990 |
| GB | 2244524 | A | 12/1991 |
| GB | 2408546 | A | 6/2005 |

OTHER PUBLICATIONS

Nov. 20, 2015 Search Report issued in Great Britain Patent Application No. 1509771.0.

* cited by examiner

*Primary Examiner* — Richard A Edgar
*Assistant Examiner* — Brian O Peters
(74) *Attorney, Agent, or Firm* — Oliff PLC

(57) ABSTRACT

The present invention provides a gas turbine engine comprising a tubular containment casing surrounding a rotary fan blade assembly. The radially outer perimeter (and optionally the radially inner perimeter) of the radial cross-sectional profile of the containment casing is non-circular e.g. polygonal, corrugated, fluted or wavy.

8 Claims, 4 Drawing Sheets

CONTAINMENT CASING

FIELD OF THE INVENTION

The present invention relates to a containment casing such as a fan blade containment casing for use in a gas turbine engine.

BACKGROUND OF THE INVENTION

With reference to FIG. 1, a ducted fan gas turbine engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The fan 12 comprises an assembly of blades radially extending from a hub. The fan 12 is surrounded with an annular fan containment casing 20 (having a circular axial cross-sectional profile) for containing a fan blade in the unlikely event of the release of a fan blade from its hub.

This fan containment casing 20 must be capable of withstanding the impact of the released fan blade and must also be able to contain any blade or casing fragments. Furthermore, it must be capable of withstanding the huge loads and vibrations resulting from the out of balance fan blade assembly.

The materials used to construct the fan containment casing 20 are selected for high strength and high ductility. The fan containment casing may consist of either a plain or ribbed metallic casing, for example, formed of ribbed Armco™ or titanium. Other known fan containment casings which were developed to reduce the weight of the fan containment casing comprise a plain or isogrid Kevlar™ wrapped casing e.g. an aluminium isogrid casing wrapped with an aramid fibre weave such as Kevlar™. The Kevlar™ acts to absorb the blade energy by deflecting and stretching thus feeding the load around the casing.

The load results in the circumferential propagation of a transverse displacement wave having a radial amplitude around the annular fan containment casing. Any accessories bolted onto the fan containment casing must be isolated from the Kevlar™ wrapping to ensure that they are not subjected to the transverse displacement wave and remain attached to the fan containment casing.

There is a desire to reduce the propagation of the transverse displacement wave around the circumference of the annular fan containment casing.

Known fan containment casings also typically include a liner bonded to the internal diameter to define a blade tip rub path as well as provide acoustic and aero-elastic functionality. In the event of the release of a fan blade, the liner blunts and turns the trajectory of the released blade so as to impart a glancing blow on the fan case barrel. After the radial loading (resulting in the propagation of the transverse displacement wave around the circumference of the annular fan casing), the fan case assembly is subjected to a torque loading especially in the rare occasion that the following blades pick up on the released blade and drag it around the internal diameter of the casing. This loading is magnified by the rotor out of balance (OOB) which increases both radial and torque loading. The casing has to be thickened (to around 25-30 mm) to resist this loading and maintain its shape without significant delamination or penetration. This increased thickness has undesirable weight and cost implications and most casings will never see these loads in their service lifetime.

There is a desire to increase the resistance to torque loading with a reduced thickness casing and to reduce the OOB interaction.

SUMMARY OF THE INVENTION

Accordingly, in a first aspect, the present invention provides a gas turbine engine comprising a tubular containment casing surrounding a rotary fan blade assembly, wherein the radially outer perimeter of the radial cross-sectional profile of the containment casing is non-circular.

Providing a containment casing having a radial cross-sectional profile (perpendicular to the axis of the tubular casing) which has a non-circular outer radially outer perimeter has been found to impede the circumferential propagation of the transverse displacement wave around the outer surface of the containment casing. Such an arrangement has also been found to increase the torsional stiffness of the casing with reduced thickness providing increased resistance to deformation caused by torque loading.

Optional features of the invention will now be set out. These are applicable singly or in any combination with any aspect of the invention.

In some embodiments, a radially inner perimeter of the radial cross-sectional profile of the containment casing is also non-circular.

Having a casing with a non-circular inner surface has been found to provide "hard points" (where the minimum radial dimension of the casing occurs) which come into contact with the blade tips after the release of a fan blade to shear off tip portions of the remaining unreleased blades reducing the OOB loading. This also increases the gap around the blades and so reduces the windmilling forcing of the fan, which, in turn, reduces engine drag and OOB orbiting.

In some embodiments, the radially outer perimeter is polygonal. In some embodiments, the radially inner perimeter is polygonal. It is preferred that the shape of the outer perimeter substantially matches the shape of the inner perimeter.

The discrete annular changes around the outer/inner perimeter of the cross-sectional profile have been found to impede the circumferential propagation of the transverse displacement wave.

In some embodiments, the outer and/or inner perimeter of the radial cross-sectional profile of the containment casing is a regular polygon where the angles at the apices between adjoining wall portions are all equal. In some embodiments, the outer and/or inner perimeter of the radial cross-sectional profile of the containment casing is a cyclic polygon i.e. all apices lie on a respective single circle.

In embodiments where the tubular containment casing has a polygonal outer perimeter, the containment casing comprises a series of axially-extending wall portions each having a respective radially outer surface, the outer perimeter being defined by the outer surfaces of the wall portions, and a series of axially-extending external edges between the outer surfaces of adjoining wall portions.

Where the tubular containment casing has a polygonal inner perimeter, each of the series of axially-extending wall portions has a radially inner surface, the inner perimeter being defined by the inner surface of the wall portions, and the containment casing comprises a series of axially-extending internal joins between the inner surfaces of adjoining wall portions. Each external edge is radially aligned with its respective internal join.

In some embodiments, the outer and/or inner perimeter of the radial cross-sectional of the containment casing is a square, pentagon, hexagon, heptagon, octagon, nonagon, decagon, hendecagon or dodecagon, i.e. the containment casing comprises four, five, six, seven, eight, nine, ten, eleven or twelve wall portions joined by four, five, six, seven, eight, nine, ten, eleven or twelve external/internal joins.

It is preferred that the number of fan blades in the fan blade assembly is not divisible by the number of wall portions. This helps avoid vibration coupling of the casing wall portions and the fan blades during normal running tip rubs. Five or seven wall portions may be used for 16-18 fan blades, seven wall portions for 20 fan blades and nine wall portions for 16 or 20 fan blades. The ideal is where both the number of faces and number of blades are prime numbers but this is not always practical.

In some embodiments with a polygonal inner and/or outer perimeter, each axially extending wall portion has an inner and/or outer surface that is substantially planar.

In some embodiments, the radially outer perimeter is corrugated, fluted or wavy. In some embodiments, the radially inner perimeter is corrugated, fluted or wavy. It is preferred that the shape of the outer perimeter substantially matches the shape of the inner perimeter.

The corrugations, flutes or waves may be sinusoidal.

In embodiments, where the tubular containment casing has a corrugated, fluted or wavy outer perimeter, the containment casing comprises an axially-extending tubular wall portion having a radially outer surface, the outer perimeter being defined by the outer surface of the wall portion. In this case, the outer surface comprises a series of peaks and troughs defining the corrugations, fluting or waves.

Where the tubular containment casing has a corrugated, fluted or wavy inner perimeter, the axially-extending tubular wall portion has a radially inner surface, the inner perimeter being defined by the inner surface of the wall portion. In this case, the inner surface comprises a series of peaks and troughs defining the corrugations, fluting or waves.

The peaks and troughs of the outer surface may be aligned with the peaks and troughs on the inner surface.

It is preferable that no trough on the inner surface coincides with the bottom dead centre (BDC) of the casing to avoid pooling of fluid at the BDC which can lead to a weight increase and corrosion risk. Alternatively, a drain hole can be provided at the BDC of the casing.

It is preferred that the number of fan blades in the fan blade assembly is not divisible by the number of peaks/troughs. This helps avoid vibration coupling of the casing and the fan blades during normal running tip rubs. Five or seven peaks/troughs may be used for 16-18 fan blades, seven peaks/troughs for 20 fan blades and nine peaks/troughs for 16 or 20 fan blades. The peaks/troughs may taper in their extent in an axial direction so as to minimise weight where the corrugations are not required. This/these taper(s) also add axial stiffness.

In some embodiments, the wall portion(s) have a substantially uniform thickness i.e. the spacing between the inner and outer surfaces is substantially constant.

In some embodiments, the wall portion(s) extend(s) to the axial ends of the containment casing. In other embodiments, the tubular containment casing comprises at least one axial end portion having a circular inner/outer perimeter for the radial cross-sectional profile e.g. two axial end portions at opposing axial ends. The wall portion(s) may extend(s) from the at least one axial end portion e.g. between two such axial end portions. The or each axial end portion may be provided with a respective radially-extending flange.

In some embodiments, especially where the inner/outer perimeter of the radial cross-sectional profile is polygonal, the containment casing i.e. the wall portion(s) are formed of metal (e.g. titanium or aluminium). Such a metal containment casing could be formed by hydro or superplastically deforming an annular ring roll forged metal containment casing into a containment casing have a polygonal radial cross-section.

The containment casing may be formed may be formed of a composite material e.g. by a filament or fibre tape winding process (e.g. Automatic Tape Laying (ATL)) using a polygonal mandrel. The composite material may comprise an organic matrix with fibrous reinforcements e.g. carbon and/or glass fibrous reinforcements.

The containment casing may comprise a radially outer aramid layer of Kevlar™.

The containment casing may comprise a radially inner liner for defining an annular fan blade path (i.e. the liner has an annular inner surface). The radially inner liner will abut the inner surface of the wall portion(s). Where the liner has an annular outer surface, any gaps between the liner outer surface and the inner surface of the wall portions (e.g. at the internal joins between wall portions in the polygonal casing or at the troughs in the inner surface in the corrugated/fluted/waved casing) may be filled with a foaming adhesive. Alternatively, the radially inner liner may have an outer surface matching the inner surface of the wall portion(s).

The radially inner liner may be retained by at least one pair of spaced circumferentially-extending Jubilee Clip Straps that are flexible in the circumferential direction and radial direction but stiff in torsion and in the axial direction.

In some embodiments, the containment casing having a polygonal inner perimeter of the radial cross-sectional profile further comprises at least one elongated fillet radius along a one of the internal joins. The fillet radius helps avoid fibre crimping if the wall portions are made of a fibre-reinforced composite material. In some embodiments, the containment casing comprises a plurality of fillet radii, one along each respective internal join. Where fillet radii are provided at all internal joins, the containment casing may have a substantially circular inner profile. The radially inner liner may abut the inner surface of the walls portions and the fillet radii.

In some embodiments, the wall portions of the containment casing may each have an axial extent sufficient to cover 15 degree forward and 20 degrees aft of the centre of gravity plane of the fan blade assembly rotor. This is a requirement to cover the potential debris angles from a released blade i.e. to protect where the blade is likely to hit the casing.

In some embodiments, the containment casing comprises no radial struts.

In a second aspect, the invention provides a method of making a containment casing for use in the first aspect, said method comprising:

forming an annular containment casing; and deforming the outer surface of the annular containment casing to form a containment casing having radial cross-sectional profile with a non-circular outer perimeter.

In some embodiments, the annular containment casing is formed by ring roll forging e.g. ring roll forming of metal such as Armco or titanium.

In some embodiments, the annular containment casing is formed by extrusion of metal e.g. aluminium.

In some embodiments, the outer surface of the containment casing is deformed by hydro or superplastically deformation.

In a third aspect, the present invention provides a method of making a containment casing for use in the first aspect, said method comprising a filament or tape winding process using a polygonal, corrugated, fluted or wavy mandrel.

The filament or tape winding process may comprise winding dry fibres (which may be woven, braided or through-stitched) and then resin transfer moulding (RTM) to cure and achieve the final shape. Alternatively, the process may comprise winding pre-impregnated tapes of carbon and/or glass and/or aramid and then curing to achieve the final shape.

Automatic Tape Laying (ATL) or Automated Fibre Placement (AFP) using pre-impregnated tapes onto a suitable mandrel are alternative methods of manufacture.

In a fourth aspect, the present invention provides a method of making a containment casing for use in the first aspect, said method comprising hot die forging.

The method may comprise hot die forging of metal e.g. Armco.

The method may comprise hot die forging using a multi-part hydraulic die set.

In the second to fourth aspects, an aramid layer such as a Kevlar™ layer may be wrapped around the outer surfaces of the wall portions. Wraps of other suitable materials such as Ultra High Molecular Weight Polyethylene (UHMW PE) may be used instead.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
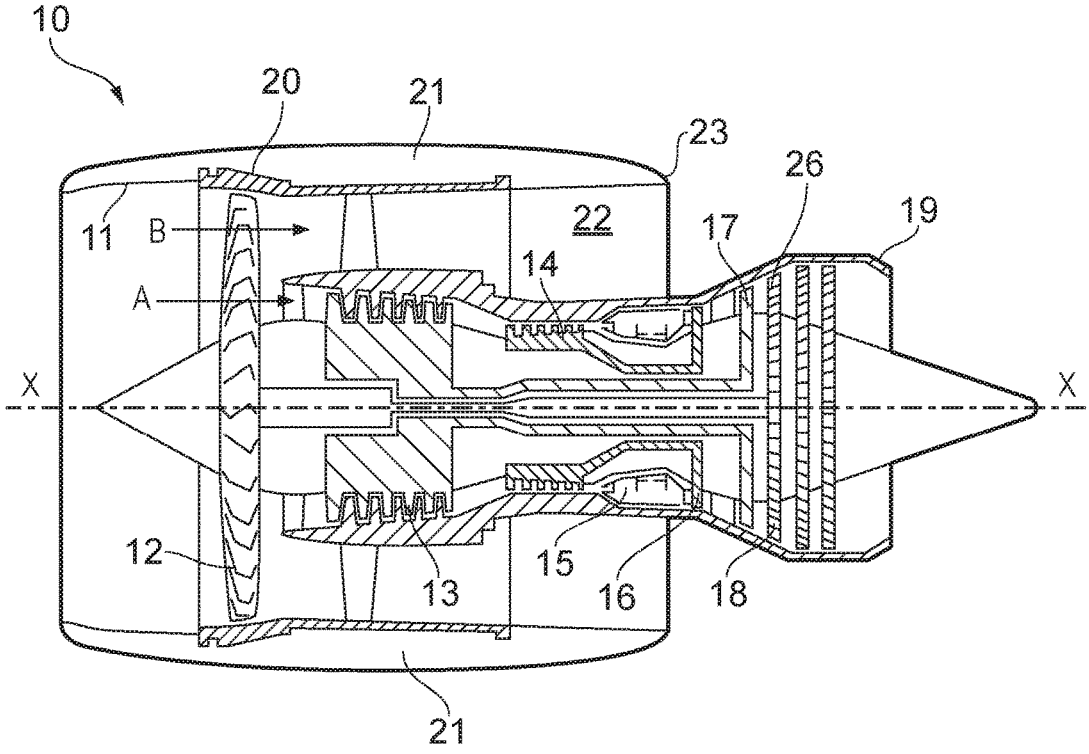
FIG. 1 shows a ducted fan gas turbine engine.
Figure 2:
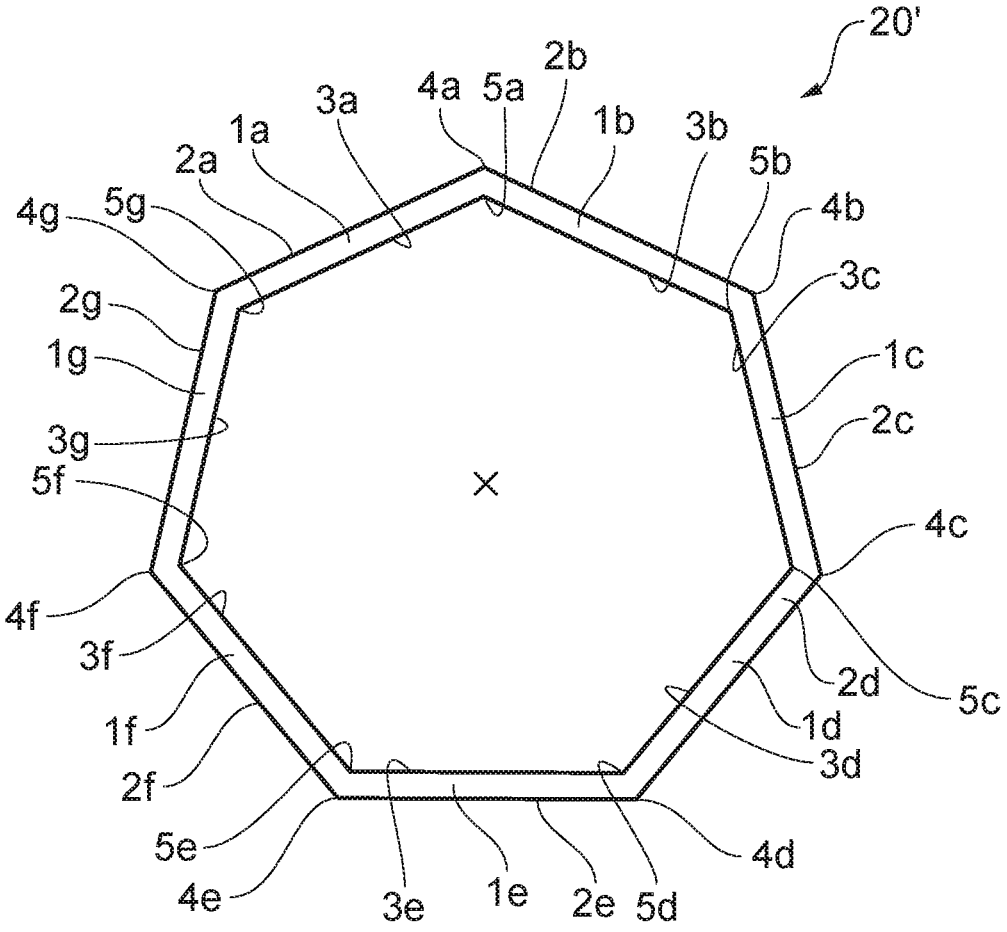
FIG. 2 shows a radial cross-sectional profile of a containment casing used in a first embodiment of the present invention.

FIG. 2 shows a radial cross-sectional profile of a tubular containment casing used in a first embodiment of the present invention.

The containment casing 20' comprises a series of seven axially-extending planar wall portions 1*a*, 1*b*, 1*c*, 1*d*, 1*e*, 1*f*, 1*g* each having a respective radially outer surface 2*a*, 2*b*, 2*c*, 2*d*, 2*e*, 2*f*, 2*g* and a respective radially inner surface 3*a*, 3*b*, 3*c*, 3*d*, 3*e*, 3*f*, 3*g*. A series of axially-extending external edges 4*a*, 4*b*, 4*c*, 4*d*, 4*e*, 4*f*, 4*g* are provided between the outer surfaces of adjoining wall portions and a series of axially extending internal joins 5*a*, 5*b*, 5*c*, 5*d*, 5*e*, 5*f*, 5*g* are provided between the inner surfaces of adjoining wall portions.

The external edges 4*a*, 4*b*, 4*c*, 4*d*, 4*e*, 4*f*, 4*g* and internal joins 5*a*, 5*b*, 5*c*, 5*d*, 5*e*, 5*f*, 5*g* are radially aligned in pairs.

All of the external edges 4*a*, 4*b*, 4*c*, 4*d*, 4*e*, 4*f*, 4*g* comprise a discrete angular change between the outer surfaces 2*a*, 2*b*, 2*c*, 2*d*, 2*e*, 2*f*, 2*g* of adjoining wall portions.

All of the internal joins 5*a*, 5*b*, 5*c*, 5*d*, 5*e*, 5*f*, 5*g* comprise a discrete angular change between the inner surfaces 3*a*, 3*b*, 3*c*, 3*d*, 3*e*, 3*f*, 3*g* of adjoining wall portions.

It can be seen in FIG. 2 that both the outer perimeter (defined by the outer surfaces 2*a*, 2*b*, 2*c*, 2*d*, 2*e*, 2*f*, 2*g*) and inner perimeter (defined by the inner surfaces 3*a*, 3*b*, 3*c*, 3*d*, 3*e*, 3*f*, 3*g*) of the radial cross-sectional profile of the containment casing (perpendicular to the axis of the tubular casing) are polygonal i.e. heptagonal.

The discrete angular changes between the wall portions between act to impede the circumferential propagation of the transverse displacement wave around the containment casing.

The number of fan blades in the fan blade assembly is not divisible by the number of wall portions. This helps avoid vibration coupling of the casing and the fan blades during normal running tip rubs.

The containment casing 20' is formed by first forming an annular containment casing having a circular radial cross-sectional profile by ring roll forging of titanium. The annular casing is then hydro or plastically deformed to create the axially extending external edges 4*a*, 4*b*, 4*c*, 4*d*, 4*e*, 4*f*, 4*g* and internal joins 5*a*, 5*b*, 5*c*, 5*d*, 5*e*, 5*f*, 5*g* between the wall portions 1*a*, 1*b*, 1*c*, 1*d*, 1*e*, 1*f*, 1*g* ensuring a discrete angular change between the outer surfaces 2*a*, 2*b*, 2*c*, 2*d*, 2*e*, 2*f*, 2*g* and inner surfaces 3*a*, 3*b*, 3*c*, 3*d*, 3*e*, 3*f*, 3*g* of the adjoining wall portions 1*a*, 1*b*, 1*c*, 1*d*, 1*e*, 1*f*, 1*g*.

A layer of ballistic protection such as Kevlar™ (not shown) may be wrapped around the outer surfaces 2*a*, 2*b*, 2*c*, 2*d*, 2*e*, 2*f*, 2*g*.

Figure 3A:
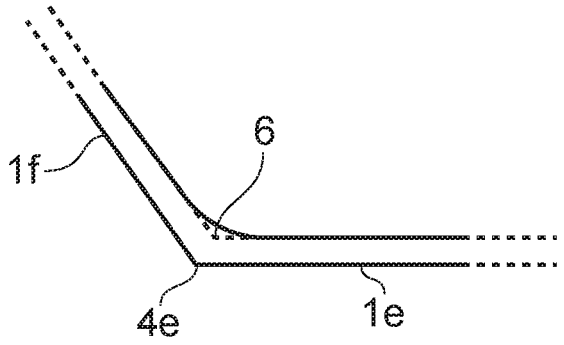
FIGS. 3*a*, 3*b* and 3*c* each show an enlarged view of an internal join in the containment casing of FIG. 1.

As shown in FIG. 3*a*, a fillet radius 6 may be affixed along each internal join to restore the circular inner profile and to help avoid crimping of fibres where the casing is formed of fibre-reinforced organic matrix composite.

Figure 3B:
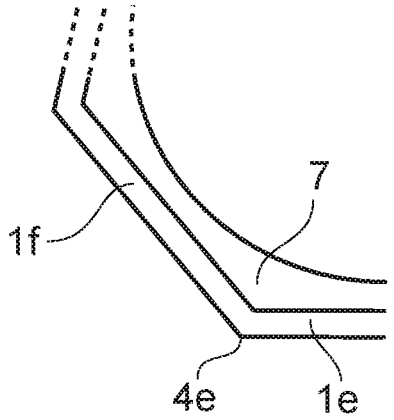

As shown in FIG. 3*b*, a liner 7 having an annular inner surface and an outer surface matching the inner surface of the wall portions may be provided to form an annular fan blade path. The liner may be formed of low density honeycomb material.

Figure 3C:
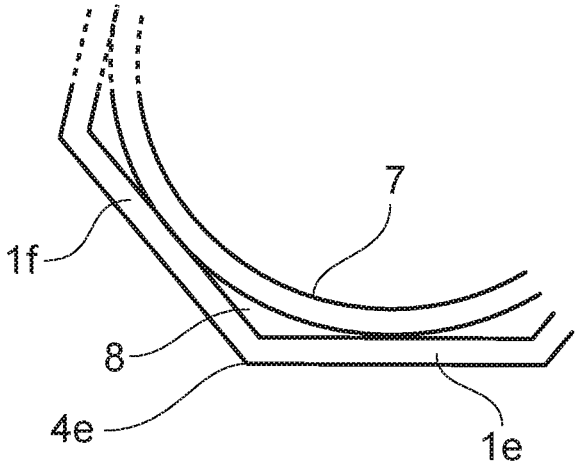

As shown in FIG. 3*c*, a liner 7' having an annular inner and outer surface may be provided to form an annular fan blade path. Gaps 8 between the inner surface of the casing and the outer surface of the liner may be filled with a foaming adhesive.

Figure 4:
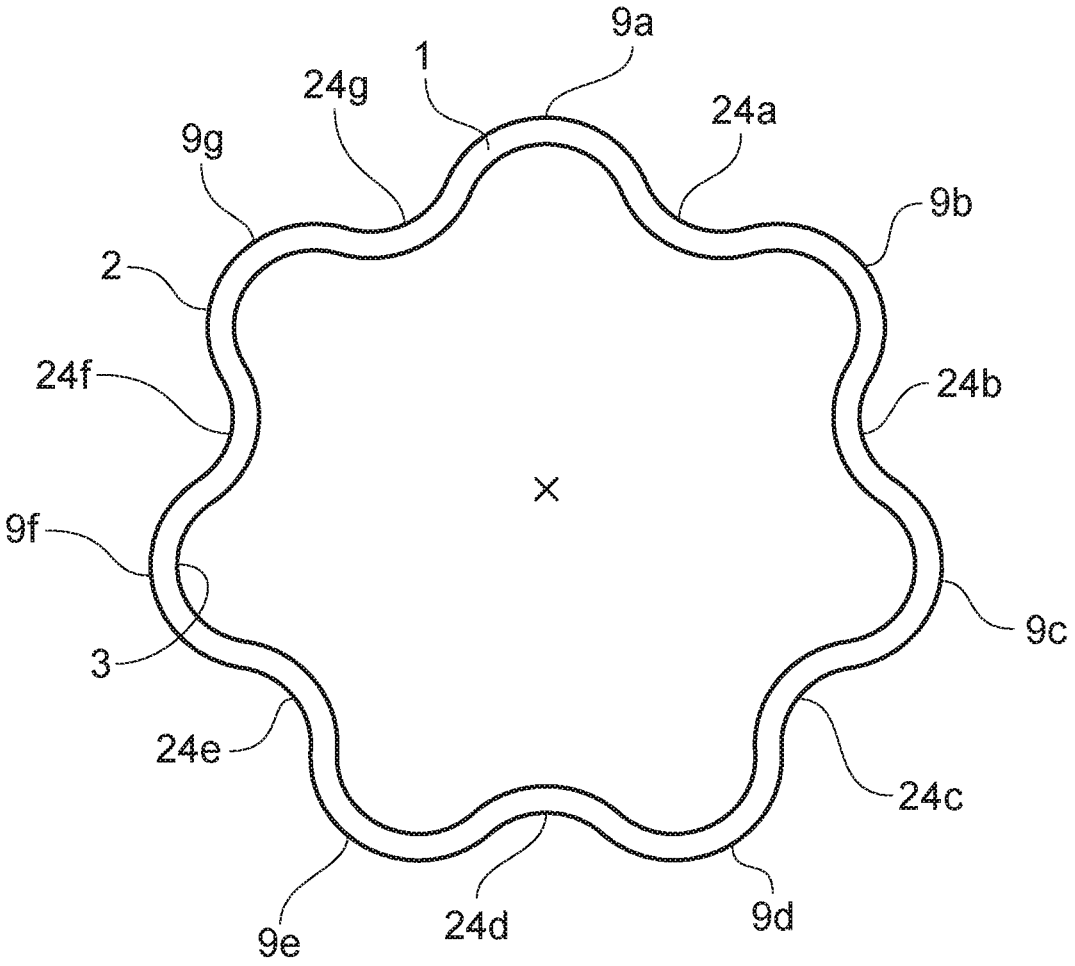
FIG. 4 shows a radial cross-sectional profile of a containment casing used in a first embodiment of the present invention.

FIG. 4 shows a radial cross-sectional profile of a tubular containment casing used in a second embodiment of the present invention. Casing variations are exaggerated to demonstrate the principle.

The containment casing 20" comprises an axially-extending wall portion 1 having a radially outer surface 2 and a radially inner surface 3. The outer surface 2 and inner surface 3 each have a series of peaks 9*a*, 9*b*, 9*c*, 9*d*, 9*e*, 9*f*, 9*g* and troughs 24*a*, 24*b*, 24*c*, 24*d*, 24*e*, 24*f*, 24*g* defining the corrugations, fluting or waves.

The peaks and troughs of the outer surface 2 are aligned with the peaks and troughs on the inner surface 3.

The number of fan blades in the fan blade assembly is not divisible by the number of peaks/troughs. This helps avoid vibration coupling of the casing and the fan blades during normal running tip rubs.

In the casings shown in FIGS. 2 and 4, the inner surface has been found to provide "hard points" (where the minimum radial dimension of the casing occurs) which come into contact with the blade tips after the release of a fan blade to shear off tip portions of the remaining unreleased blades reducing the OOB loading.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A gas turbine engine, comprising:

a tubular containment casing comprising (i) a series of axially-extending wall portions each having a radially outer surface and a radially inner surface, (ii) a series of axially-extending external edges between the outer surfaces of adjoining ones of the wall portions, and (iii) a series of axially-extending internal joins between the inner surfaces of adjoining ones of the wall portions; and a rotary fan blade assembly, wherein a radially outer perimeter and a radially inner perimeter of a radial cross-sectional profile of a portion of the containment casing surrounding the fan blade assembly are polygonal.

2. The gas turbine engine according to claim 1, wherein at least one of the radially outer perimeter and the radially inner perimeter is a square, pentagon, hexagon, heptagon, octagon, nonagon, decagon, hendecagon or dodecagon.

3. The gas turbine engine according to claim 1, wherein the number of fan blades in the rotary fan blade assembly is not divisible by the number of axially-extending wall portions.

4. The gas turbine engine according to claim 1, wherein at least one of the radially outer and inner surfaces of each axially-extending wall portion is substantially planar.

5. The gas turbine engine according to claim 1, wherein:

the tubular containment casing comprises opposing axial end portions each having a circular cross-sectional profile; and the axially-extending wall portions extend between the axial end portions of the containment casing.

6. The gas turbine engine according to claim 1, wherein the axially-extending wall portions are formed of a fibre-reinforced organic matrix composite.

7. The gas turbine engine according to claim 1, further comprising a radially outer layer of ballistic wrapping.

8. The gas turbine engine according to claim 1, further comprising a radially inner liner for defining an annular fan blade path.

* * * * *